United States Patent [19]

Andrew

[11] 4,088,002

[45] May 9, 1978

[54] METHOD AND MEANS OF STRAIGHTENING CYCLE FRAMES

[75] Inventor: Keith V. Andrew, Des Moines, Iowa

[73] Assignee: G.C. Barnes Tooling and Mfg. Co., Inc., Baxter, Iowa

[21] Appl. No.: 594,782

[22] Filed: Jul. 10, 1975

[51] Int. Cl.[2] ..... B21D 1/14; B21D 3/10; B21D 3/16; B21J 13/04

[52] U.S. Cl. ..... 72/389; 72/455; 72/457; 72/705

[58] Field of Search ..... 72/388, 447, 705, 389, 72/455, 457; 269/71; 211/17, 22; 254/1; 248/13

[56] References Cited

U.S. PATENT DOCUMENTS

| | | | |
|---|---|---|---|
| 1,903,436 | 4/1933 | Brown | 72/388 X |
| 2,069,249 | 2/1937 | Hunt | 72/705 X |
| 2,140,686 | 12/1938 | Bennett | 72/705 X |
| 2,559,250 | 7/1951 | Jackson | 72/705 X |
| 2,627,295 | 2/1953 | Jackson | 72/705 X |
| 2,705,040 | 3/1955 | Howick | 72/705 X |
| 3,214,959 | 11/1965 | Bowden | 72/705 |
| 3,835,693 | 9/1974 | Majersky | 72/705 |
| 3,927,550 | 12/1975 | Samuelson | 72/705 |
| 3,948,106 | 4/1976 | Armbruster | 72/705 |
| 4,003,239 | 1/1977 | Step | 72/705 X |

FOREIGN PATENT DOCUMENTS

| | | | |
|---|---|---|---|
| 1,295,511 | 11/1972 | United Kingdom | 72/705 |

*Primary Examiner*—E. M. Combs
*Assistant Examiner*—D. M. Gurley
*Attorney, Agent, or Firm*—Zarley, McKee, Thomte, Voorhees & Sease

[57] ABSTRACT

The means of this invention comprises a rectangular cage means including spaced apart frame members adapted to receive the cycle frame therein. A plurality of length adjustable support members are secured to the frame members for supporting and positioning the cycle frame relative to the cage means. A hydraulic ram is selectively adjustably secured to the frame members as required and includes a rod portion adapted to engage the cycle frame to deflect or bend the same upon actuation of the ram means. A device is also disclosed for straightening the frame head portion of the cycle frame and for determining if the frame head has been properly vertically aligned and to determine if the frame has the proper rake angle. The method of straightening the cycle frame is also disclosed.

7 Claims, 10 Drawing Figures

10.

METHOD AND MEANS OF STRAIGHTENING CYCLE FRAMES

BACKGROUND OF THE INVENTION

Heretofore, a motorcycle frame repair required the removal of almost all of the motorcycle parts down to the bare frame. The removal of the parts required considerable time expenditure by the mechanic which resulted in the cost of repairing the frame to be almost equal to the price of a new frame.

Additionally, the previous method and means for straightening cycle frames did not include any means for determining the accuracy of repairs without the use of exotic gauges designed and manufactured specifically for each make and model of motorcycle.

Therefore, it is a principal object of the invention to provide a method and means for straightening a cycle frame.

A further object of the invention is to provide a means for straightening a cycle frame which is adapted to accommodate various cycle frames.

A still further object of the invention is to provide a method and means of straightening cycle frames which does not require the removal of an excessive number of parts of the frame.

A further object of the invention is to provide a frame straightening machine which is economical of manufacture.

A still further object of the invention is to provide a means for straightening cycle frames which includes an accurate method of determining the accuracy of repair.

A still further object of the invention is to provide a means of straightening cycle frames including means for determining the proper vertical alignment and rake angle of the frame head.

A still further object of the invention is to provide a means of straightening cycle frames which prevents further damage to the frame during the straightening operation.

A still further object of the invention is to provide a method and means of straightening cycle frames which accomplishes new, useful and unexpected results.

These and other objects will be apparent to those skilled in the art.

BRIEF DESCRIPTION OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings, in which:

Figure 1:
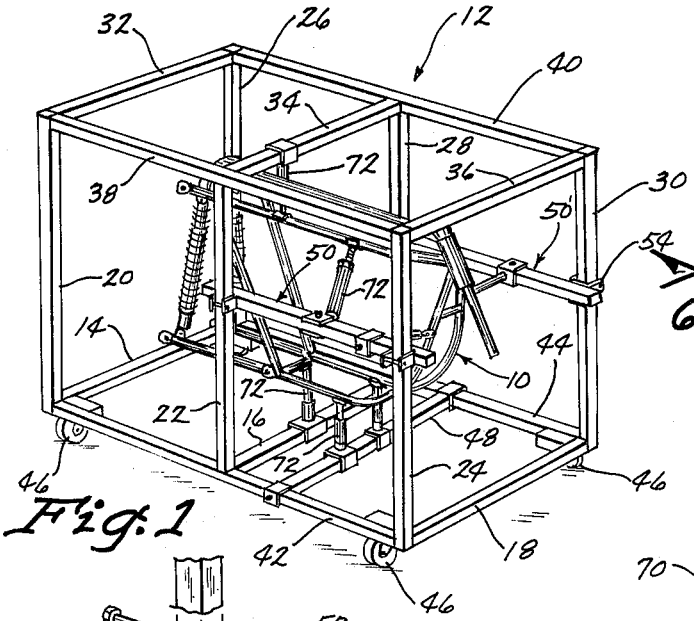
FIG. 1 is a perspective view of the apparatus of this invention illustrating a cycle frame positioned therein.
Figure 2:
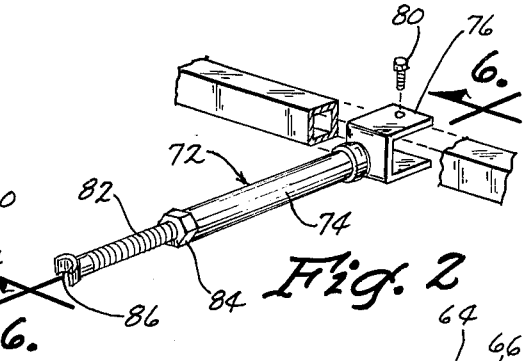
FIG. 2 is a partial perspective view illustrating one of the length adjustable support members.
Figure 3:
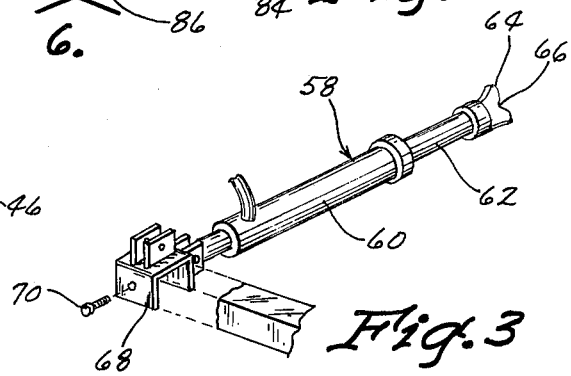
FIG. 3 is a partial perspective view illustrating the power ram.
Figure 4:
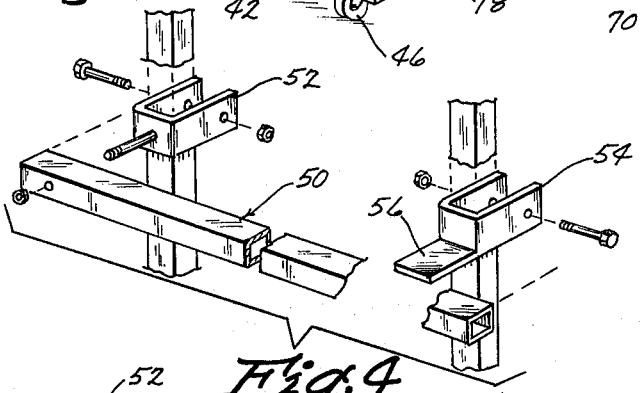
FIG. 4 is a partial exploded perspective view of the supports which are selectively secured to the side frame members of the cage.

DESCRIPTION OF THE PREFERRED METHOD AND MEANS .

In the use of the apparatus disclosed herein it is first necessary to determine what portion of the cycle frame is damaged. It is also recommended that the type of steel utilized in the cycle frame be determined. A large portion of the available street and trail bikes use a mild steel frame although the use of other types of steel is becoming more commonplace. Thus, minor bends or large bends of general curvatures can be safely repaired utilizing the apparatus of this invention without causing undue weakness to the frame tubing. It has been found that heat need be applied to the cycle frame only in rare cases.

In the drawings, the numeral 10 refers generally to a cycle frame which is in need of straightening. Although the drawings illustrate that the wheels, motor, gas tank, etc. have been removed from the frame, it has been found that repair of the cycle frame with the apparatus disclosed herein normally does not require the removal of such component parts. The drawings illustrate the various parts of the motorcycle having been removed for purposes of clarity.

The numeral 12 refers generally to a rectangular-shaped cage generally comprising horizontally spaced and horizontally disposed bottom frame members 14, 16 and 18. Cage 12 also includes horizontally spacaed and vertically disposed side frame members 20, 22 and 24 at one side thereof and horizontally spaced and vertically disposed side frame members 26, 28 and 30 at the other side thereof. Top frame member 32 extends between the upper ends of frame members 20 and 26 while top frame member 34 extends between the upper ends of side frame members 22 and 28. Top frame member 36 extends between the upper ends of side frame members 24 and 30. Frame members 38 and 40 are provided on the cage means as are frame members 42 and 44. As seen in FIG. 1, the cage may be provided with a plurality of castor wheels 46.

The numeral 48 refers to an elongated support means adapted to have its opposite ends adjustably slidably secured to the frame members 42 and 44. The numeral 50 refers to an elongated support means having one end thereof pivotally secured to a clamp 52 which is vertically adjustably secured to side frame member 22 as seen in FIG. 1. Clamp 54 is vertically adjustably secured to frame member 24 as illustrated in FIG. 1 and has a ledge portion 56 extending inwardly therefrom which is adapted to support the other end of the elongated support means 50. The numeral 50' refers to an elongated support means identical to support means 50 but which is secured to the side frame members 28 and 30.

The numeral 58 refers to a hydraulic cylinder, power ram or the like including a body portion 60 having an extendible rod 62 extending therefrom. The tip 64 is mounted on the outer end of rod 62 and has a V-shaped notch 66 formed therein adapted to facilitate the engagement of the tip 64 with the cycle frame. The base end of the hydraulic cylinder 58 is pivotally connected to a bracket 68 which is adapted to be selectively adjustably secured to the cage means by means of the bolt 70 in the manner illustrated in the drawings. Hydraulic cylinder 58 is of conventional design and is adapted to be connected to a source of hydraulic pressure to cause the extension of the rod 62.

The numeral 72 refers generally to a length adjustable support member generally comprising a tubular portion 74 pivotally secured to a bracket 76 by pin 78. Bracket 76 may be selectively adjustably secured to the cage means 12 by the bolt 80 as illustrated in the drawings. An elongated bolt 82 is removably positioned in the tubular portion 74 and has a nut 84 threadably mounted thereon for engagement with the end of the tubular portions 74 to limit or position the bolt 82 relative to the tubular portion 74. Bolt 82 is provided with a U-shaped portion 86 on its outer end adapted to engage the cycle frame.

After determining what portion of the cycle frame is damaged, the cycle frame is placed within the cage 12 as illustrated in FIG. 1. Member 48 is slidably positioned on support frame members 42 and 44 as required with the length adjustable supports 72 then being positioned on the frame members 16 and 48 so that the lower portion of the cycle frame is supported thereby. The bolts on the members 72 are threadably adjusted until the cycle frame is level. The support means 50 and the support means 50' are then selectively positioned relative to the frame members 22, 24 and 28, 30. Length adjustable members 72 are then adjustably positioned on the means 50 and 50' so that the U-shaped portions 86 thereon engage and support the upper portion of the cycle frame. Again, the bolts on the members 72 would be length adjusted until the proper engagement with the cycle frame is achieved. A length adjustable member 72 is also preferably secured to the top frame member 34 as illustrated in FIG. 1 so that the bolt member engages the upper portion of the cycle frame as also illustrated in FIG. 1. Thus, as many of the length adjustable members 72 are employed so that the cycle frame is properly positioned within and locked in place thereby.

Figure 5:
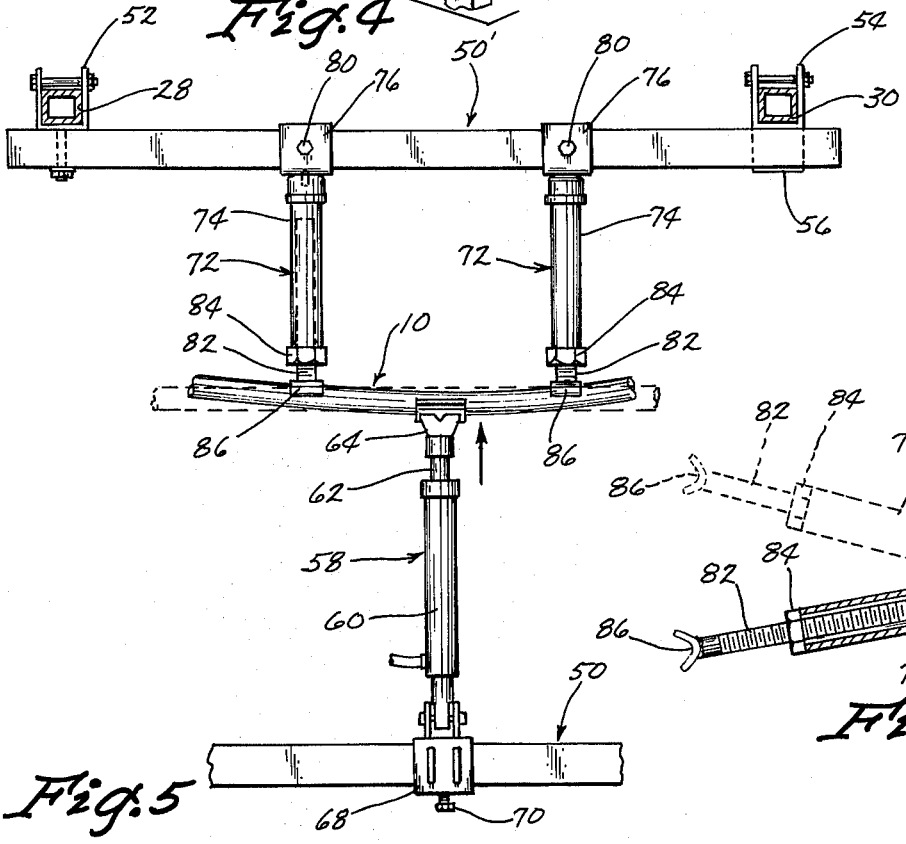
FIG. 5 is a partial top view illustrating the manner in which the hydraulic ram straightens the frame held in position by a pair of length adjustable members.
Figure 6:
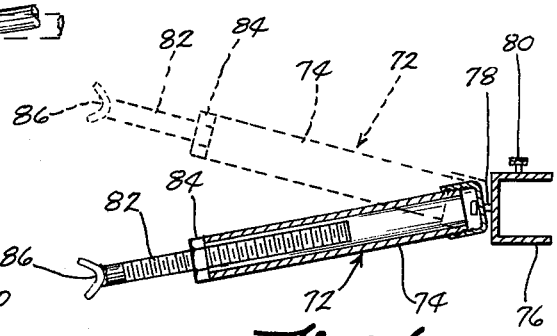
FIG. 6 is a sectional view seen on lines 6—6 of FIG. 2.

The hydraulic ram 58 is then employed to straighten those portions of the cycle frame which have been damaged. FIG. 5 illustrates the hydraulic ram 58 adjustably secured to the elongated support means 50 so that the tip 64 is in engagement with the cycle frame 10 which is held in place by a pair of members 72. Actuation of the hydraulic cyclinder 58 causes the rod 62 to be extended therefrom so that the frame 10 is straightened. The members 72 maintain the frame in position and permit the hydraulic ram 58 to straighten only that portion of the frame requiring straightening. The hydraulic ram 58 may be secured to any portion of the cycle frame as desired to exert force against the cycle frame to achieve the proper straightening. The pivotal connection of the elongated support means 50 and 50' with the clamps at one end thereof permits the members to be inclined as desired to permit the proper positioning of the members 72 or the hydraulic cylinder 58.

Figure 7:
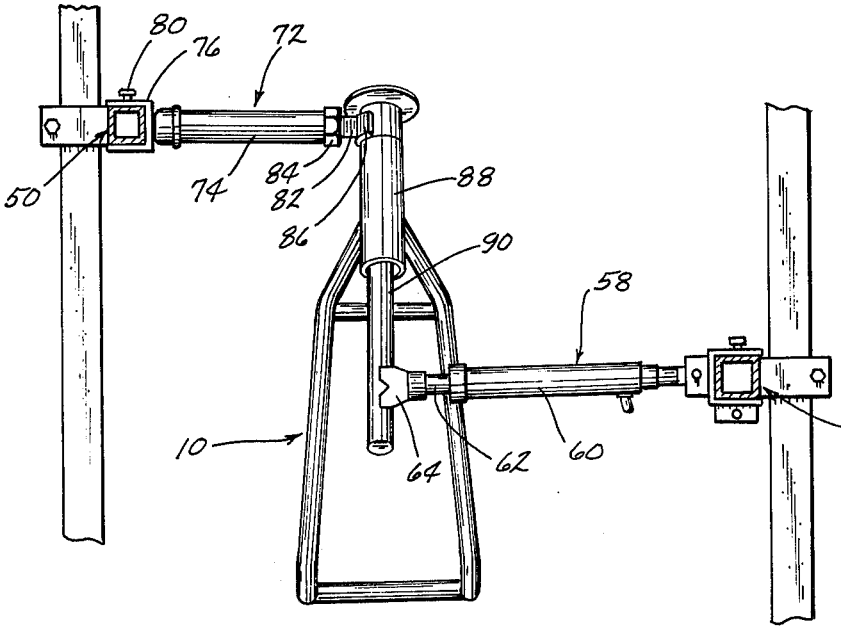
FIG. 7 is a partial front view illustrating the means by which the frame head is straightened.

If the frame head 88 has been bent, it is necessary to straighten the same so that it will have the proper vertical alignment as well as the proper rake angle. The numeral 90 refers to an elongated pipe which may be inserted into the head 88 as illustrated in FIG. 7. As seen in FIG. 7, a length adjustable support 72 is secured to the support means 50 so that the U-shaped portion 86 engages the upper end of the pipe 90. As also seen in FIG. 7, hydraulic ram or cylinder 58 has been selectively adjustably secured to the support means 50' so that the tip 64 on rod 62 engages the lower end of the pipe 90. Actuation of the hydraulic cylinder 58 causes the pipe 90 to deflect the frame head 88 in a clockwise direction as view in FIG. 7. If it was necessary to rotate the frame head 88 in a counter-clockwise direction as viewed in FIG. 7, hydraulic cylinder 58 would be secured to the support means 50 with the element 72 being secured to the support means 50'.

Figure 8:
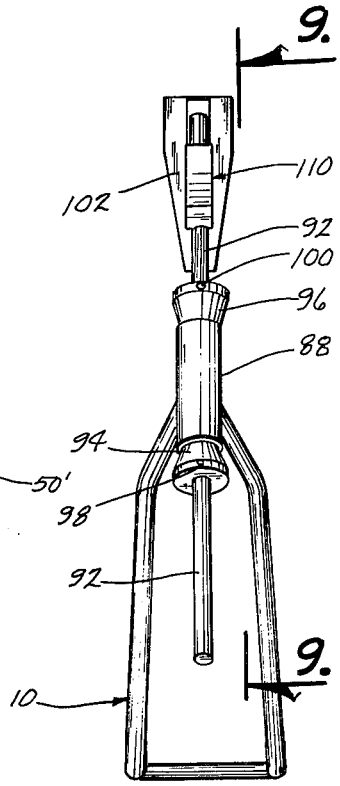
FIG. 8 is a front view of the frame having the device installed therein for determining if the frame head has been properly and vertically aligned and to determine if the proper rake angle has been achieved.
Figure 9:
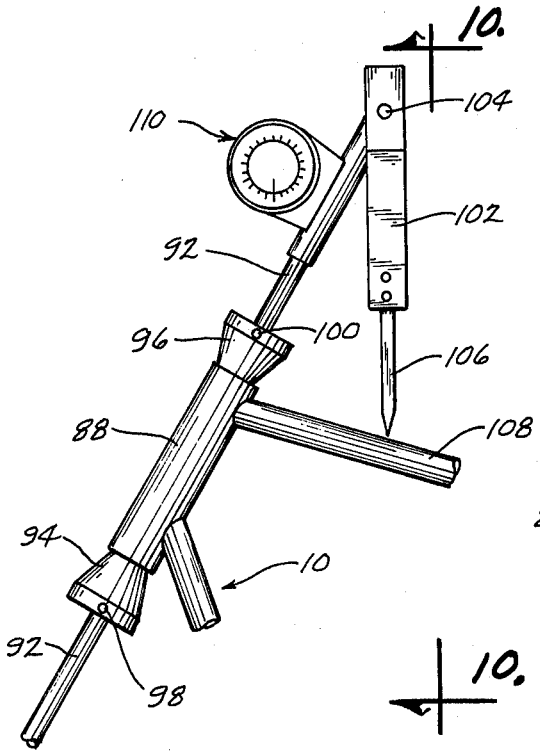
FIG. 9 is a side view as seen on lines 9—9 of FIG. 8.
Figure 10:
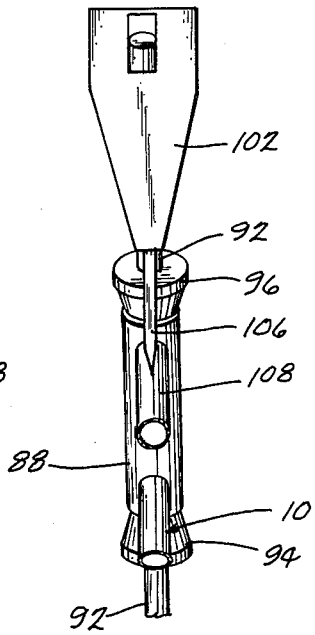
FIG. 10 is a sectional view seen on lines 10—10 of FIG. 9.

After straightening the frame head 88, it is necessary to determine if the proper vertical alignment and rake angle has been achieved. FIGS. 8–10 illustrate the apparatus for determining the vertical alignment and rake angle of the frame head 88. An elongated rod 92 is extended through the frame head 88 and has a pair of cone-shaped collars 94 and 96 selectively adjustably secured thereto. When the rod 92 has been inserted through the frame head 88, the collars 94 and 96 are slidably moved relative to the rod 92 so that the inner ends thereof are received by the frame head 88 as illustrated in FIG. 9 to center the rod 92 relative to the frame head 88. The screws 98 and 100 are then tightened to maintain the collars 94 and 96 in position. Gauge 102 is pivotally connected about a horizontal axis to the upper end of the rod 92 at 104. Gauge 102 includes a pin pointer 106 extending downwardly therefrom. As illustrated in FIG. 10, if the frame head 88 has been straightened so as to achieve perfect vertical alignment, the lower end of the pin pointer 106 will be hanging directly over the center line of the backbone of the cycle frame 10. The numeral 110 refers to a conventional "magnetic protractor" which is adapted to be magnetically affixed to the rod 92 in the manner illustrated in FIG. 9. With the magnetic protractor 110 mounted on the rod 92, the protractor gives a direct reading of the head gauge angle to determine if the proper rake angle has been achieved. Before this check is accurate, it is necessary to be sure that the motorcycle is perfectly level in the cage.

Thus it can be seen that a novel method and means has been described for straightening a cycle frame which does not require removal of an excessive number of component parts of the frame. It can also be seen that the method and means described herein insures that the cycle frame will be properly held in position as straightening forces are applied thereto to prevent damage to the cycle and to insure that the frame will be properly straightened. Thus it can be seen that the method and means accomplishes at least all of its stated objectives.

I claim:

1. A means for straightening cycle frames comprising, a cage means including spaced-apart frame members adapted to receive the cycle frame therein, said cage means including vertically disposed side frame members, top frame members secured to and extending between the upper ends of said side frame members, and bottom frame members secured to and extending between the lower ends of said side frame members, length adjustable thrust support members for selective attachment to said, top, side and bottom frame members in force opposing disposition for opposing engagement with the cycle frame to securely lock said cycle frame to said cage means to prevent relative movement between said cycle frame and said cage means, and a power ram means for selective adjustable connection to said frame members and having an extendible rod adapted to engage and deflect portions of said cycle frame upon actuation of said ram means, at least some of said length adjustable thrust support members being positioned on said frame members so as to oppose the deflecting action of said ram means to maintain said cycle frame in position relative to said cage means as said power ram means deflects said portions of said cycle frame.

2. The means of claim 1 wherein at least some of said length adjustable thrust members are pivotally secured to said frame members.

3. The means of claim 1 wherein at least some of said frame members are selectively pivotally secured to said cage means.

4. The means of claim 1 wherein at least some of said frame members are selectively positioned on said cage means relative to the cycle frame.

5. A means for straightening cycle frames comprising, a cage means including spaced apart frame members adapted to receive the cycle frame therein, length adjustable support members for selective attachment to said frame members for engagement with the cycle frame to support the cycle frame relative to said cage means, and a power ram means for selective adjustable connection to said frame members and having an extendible rod adapted to engage and deflect portions of said cycle frame upon actuation of said ram means, an elongated member for insertion into the frame head of the cycle frame, said elongated member having upper and lower portions positioned above and below the frame head respectively, said power ram having means thereon for selective engagement with the upper and lower portions of said elongated member, at least one of said length adjustable members having means thereon for selective engagement with the upper and lower portions of said elongated member.

6. The means of claim 5 wherein a vertical alignment and rake angle gauge is provided for insertion into the frame head, said gauge comprising means indicating the vertical attitude of said frame head and for indicating the rake angle of the frame head.

7. The means of claim 1 wherein said cage means is wheel supported.

* * * * *